US009332884B2

(12) United States Patent
Rosser

(10) Patent No.: US 9,332,884 B2
(45) **Date of Patent: *May 10, 2016**

(54) TOILET EQUIPMENT

(71) Applicant: Glyn David Rosser, Reading (GB)

(72) Inventor: Glyn David Rosser, Reading (GB)

( * ) Notice: Subject to any disclaimer, the term of this patent is extended or adjusted under 35 U.S.C. 154(b) by 168 days.

This patent is subject to a terminal disclaimer.

(21) Appl. No.: 14/082,279

(22) Filed: Nov. 18, 2013

(65) Prior Publication Data

US 2014/0068851 A1 Mar. 13, 2014

Related U.S. Application Data

(63) Continuation-in-part of application No. 13/112,104, filed on May 20, 2011, now Pat. No. 8,584,270, which is a continuation-in-part of application No. PCT/GB2009/002711, filed on Nov. 20, 2009.

(30) Foreign Application Priority Data

Nov. 21, 2008 (GB) ..... 0821283.9

(51) Int. Cl.
*A47K 11/04* (2006.01)
*A47K 11/06* (2006.01)

(52) U.S. Cl.
CPC ..... *A47K 11/04* (2013.01); *A47K 11/06* (2013.01)

(58) Field of Classification Search
CPC ..... A47K 11/04
USPC ..... 4/483, 449, 479
See application file for complete search history.

(56) References Cited

U.S. PATENT DOCUMENTS

| | | | | |
|---|---|---|---|---|
| 1,575,131 | A | 3/1926 | Schumacher | |
| 3,657,745 | A | 4/1972 | Hickman | |
| 4,193,142 | A | 3/1980 | Henningfield | |
| 4,641,383 | A | 2/1987 | Sargent et al. | |
| 8,584,270 | B2 * | 11/2013 | Rosser | 4/483 |
| 2011/0314598 | A1 | 12/2011 | Rathbone | |

FOREIGN PATENT DOCUMENTS

| | | |
|---|---|---|
| DE | 2615883 | 10/1977 |
| DE | 19837480 | 4/2000 |
| FR | 1514151 | 1/1968 |
| FR | 2882644 | 9/2006 |
| WO | WO 95/22275 | 8/1995 |
| WO | WO 2010/058173 | 5/2010 |
| WO | WO 2010/0737027 | 7/2010 |

OTHER PUBLICATIONS

Abbreviated Internet p. 2: http://www.merriam-webster.com/dictionary/potty.

(Continued)

*Primary Examiner* — Lori Baker
(74) *Attorney, Agent, or Firm* — Robert W. J. Usher

(57) ABSTRACT

A child's potty (10) has a bowl (12) within a substantially continuous surrounding skirt (40), seat portions (16) being formed on the rim of the bowl between the bowl and the skirt, and a raised backrest (30) with side portions (32) at the rear of the potty. A discharge spout (20) extends upwardly and rearwardly from the bowl through the backrest to an outlet with a lower lip (24) at the rear of the potty behind the backrest, to allow the potty to be emptied hygienically without contamination of the sides and seat portions.

17 Claims, 9 Drawing Sheets

(56) References Cited

OTHER PUBLICATIONS

International search report (EPO) dated Feb. 19, 2010 and written Opinion for PCT/GB2009/00271.
Abbreviated Internet page: http://www.merriam-webster.com/dictionary/potty.
Page 894 of Merriam-Webster New Collegiate Dictionary, Published by Merriam-Webster in 1981.
UK patent office search report for GB0821283.9 dated Feb. 18, 2009.
www.worldobaths.co.uk/p-and-s-traps. date unknown.
Espacenet Bibliographic data DE19837480 (Schumacher).
(Machine) translation of DE19837480.
www/pourty.com/uk/, 'The Pourty Potty,' pp. 1-3, seen Jul. 2011 Date unknown.

* cited by examiner

TOILET EQUIPMENT

RELATED APPLICATIONS

This application is a continuation-in-part of U.S. patent application Ser. No. 13/112,104 filed May 20, 2011, which is a continuation-in-part of International Application No. PCT/GB2009/002711 filed Nov. 20, 2009 (20.11.2009).

BACKGROUND OF THE INVENTION

This invention relates to toilet equipment, more specifically to a chamber pot or potty, especially a potty for use by a young child. Numerous terms may be used to designate such portable containers for the reception of waste matter, specifically urine and stools, eliminated by humans, but for convenience the term "potty" will be used herein to refer to this general class of portable toilet bowl, since this term is most commonly used in the context of infant toilet training and management, where this invention has particular application.

A simple standard potty consists of a bowl supported in a stable configuration, for example on a broad flat base, or by a dependent surrounding skirt which has a level lower edge forming a more or less continuous support around the bowl, which is contained within the skirt. For use by a child, the upper rim of the bowl may be made broad to serve as a seat. After a person has used the potty, it needs first to be carefully carried to a disposal point, such as a conventional flushable toilet (water closet). The toilet lid and seat are then lifted if they are not already raised, and the contents of the potty are tipped into the toilet bowl, which is then flushed to carry away the waste. Care must be taken to avoid spillage, and even so the fluid contents of the potty are likely to run over the seat and wet the outside, requiring such further hygienic rinsing and washing as may be necessary; but completely hygienic handling at all times cannot be assured. Further, young children are curious about their bodily waste and have little or no sense of hygiene and commonly have their fingers in contact with the outside surfaces of the potty, and in their mouths, according to their age or mental capacity.

While parents and carers know the importance of hygiene, it is no easy task to ensure optimum cleanliness. The present invention has for an object to provide a potty in which that task is made easier.

SUMMARY OF THE INVENTION

In a broad aspect of the present invention, there is provided a portable child's potty comprising a waste bowl, a seat comprising two opposite seat portions situated on either side of the bowl, an upwardly and rearwardly directed waste discharge spout extending from the bowl to a rearward spout outlet, and a backrest comprising side portions extending to a height above the seat. The waste bowl is located below the seat, the backrest is located between the seat and the discharge spout outlet, and the discharge spout passes between said two opposite side portions of the backrest to the outlet at the rear of the potty. The side portions of the backrest may be connected by a bridge portion extending across the discharge spout.

Thus, the discharge spout permits the potty to be emptied by tilting or tipping it backwardly above a waste receptacle, such as a flush toilet bowl, without the waste wetting or contacting the potty seat in any way, thereby substantially improving the hygiene of the disposal operation.

The backrest rises above the discharge spout. It will be understood that the location of the backrest defines the front and back of the potty for the purposes of this specification. Likewise, some of the terms used herein to describe the potty indicate vertical distance or upward or downward orientation, such as the bowl being below the seat, the rim of the bowl having a height, and the potty having a base formed at the lower edge of a skirt. It is to be understood that these terms specifically refer to the potty in its normal orientation when set in position, typically on a horizontal support, for use by a child, rather than when tipped for emptying or cleaning, and are intended to assist understanding of the relative positioning and location of parts of the potty.

The potty preferably comprises a base on which it may be stably set down for use by a child for toilet purposes, but it is also possible that the potty may be adapted to be held in a separate support which does not demand that the potty be stable when separated from such support. A preferred base is formed by the lowermost edge of a skirt around the bowl of the potty. Such a skirt may depend from the rim of the bowl and may surround the bowl continuously or discontinuously.

When the potty is oriented for use, either freely set down on its base or in its support, the bowl is located below the seat to catch the child's eliminated waste, for which purpose the seat does not of course extend continuously across and above the bowl, but comprises one or more seat portions suitably positioned. The backrest and seat are adapted to a child's size range and act as such when a child sits on the potty. In the sitting position constrained by the backrest and seat, the bowl is under the child and the discharge spout terminates in a discharge outlet located behind the child's back, on the far side of the backrest, well away from the child's sight and reach.

The discharge spout defines the path taken by the waste from the bowl to the rear discharge outlet and provides a guide conduit for this purpose, extending from the lower parts of the bowl, in the general region under the upwardly extending backrest, rearwardly and upwardly. The backrest serves to keep the child in a forward position away from the discharge outlet, while the discharge spout extends from the bowl to the rear of the backrest. The backrest is not required to support a child on the potty, although it advantageously extends over the discharge spout from one side of the seat to the other, to assist in obstructing a child user's access to the spout when sitting on the potty, partially enclosing the spout, and also providing a convenient location for a hand grip to be formed at the rear of the potty above the waste outlet, to make the actions of carrying and emptying the potty after use more controllable. Handgrips may be provided at other locations on the potty.

Further advantageous and preferred features of the invention will be apparent from the following description and appended claims and drawings.

Advantageously, the bowl has an upper rim, which defines the height of the bowl, and the discharge spout outlet is higher than the least height of the bowl as defined by the rim. The discharge spout outlet may also be higher than the height of the seat, when the seat is formed on the rim of the bowl. This is to assist the avoidance of spillage by effluent slopping out of the discharge pipe when the potty is being carried to a WC for emptying, since the person carrying the potty can most readily watch the rim of the bowl and the seat during this process, and if the discharge spout outlet is higher than those, accidental spillage through the spout may the better be avoided.

Preferably, the discharge spout is an upwardly directed conduit or chute, rising from the bowl up to a discharge outlet, at which the spout terminates in a short lower pouring lip to eliminate, reduce or control dripping from the outlet when the potty is tipped backwards, when the contents of the bowl empty along said conduit or chute.

In one embodiment, the conduit or chute forming the discharge spout has, to its lower part, that is to say the floor of the conduit or chute, adjacent the discharge outlet, upper and underneath surfaces leading to the lower pouring lip, both of which are exposed and slightly downwardly inclined at their terminal portions towards the lip, at least when the potty is tilted backwardly for the discharge of waste.

In a second embodiment, the discharge spout extends upwardly until it reaches the final pouring lip, and its lower exterior surface is not exposed except at that final lip. In this way, the risk of fluid waste running down the outside of the discharge spout after emptying the potty is minimised, and external contamination of the potty more easily avoided.

In a third embodiment, the discharge spout is broadened for even further improved access for cleaning, and the broader spout also enables faster emptying, while a secondary guide channel is provided in the floor of the broadened spout for enhanced control when emptying smaller quantities of liquid waste.

The discharge spout is suitably of a rounded section, which, when the potty structure passes over and across the top of it and thereby encloses it above, may be a broad oval shape of sufficient size to allow for quick cleaning and access by hand. The dimensions of the spout may be selected according to a desired compromise between free flow of effluent and ease of manual access which may require a relatively broad spout, and control of the discharge on emptying and limitation of access by a child sitting on the potty which may require a relatively narrow spout.

The backrest may include a hand grip above the discharge spout, facilitating hygienic handling of the potty during emptying. A handgrip located over the discharge spout also assists in obstructing a child potty user's access to the spout. The hand grip may be formed only in the rear of the backrest, that is to say the part facing away from the bowl and seat of the potty. The hand grip may comprise a recess in the backrest forming a finger hold.

Alternatively the hand grip may be formed as a backrest bridge portion connecting opposite side portions of the backrest, of a size suitable to serve as a handle for picking up the potty. Such a hand grip may be separable from the remainder of the back rest, being connected thereto by releasable engagement means. This approach can provide more options for the potty manufacturing process, by changing the topology of the potty, apart from the separable handle, from that of an annulus to that of a sheet. The handle may then be made in a contrasting colour, if desired. Simple and secure engagement means may include snap fit connectors or latching mechanisms of generally known kinds.

A hand grip may also be provided at the front of the potty. A suitable hand grip at the front is formed in the outside of a front skirt to the bowl. This hand grip may comprise a recess forming a finger hold.

The potty may also comprise a skirt on each side of the backrest extending rearwardly on each side of the discharge spout. In addition, the backrest may have a concave front surface, when viewed in plan. Thus the sides of the backrest may reach somewhat forwardly on either side of a child sitting on the potty, both these features making it more difficult for a seated child to twist and lean around the side of the backrest and reach towards the discharge spout.

The seat is suitably formed on or above the rim of the bowl, at least one seat portion being located to each side of the bowl, forward of the backrest. A seat portion may comprise a flattened, upwardly facing and generally horizontal region of the rim of the bowl, or alternatively may comprise a raised area higher than the rim of the bowl. The seat may be interrupted at the front of the potty by a raised shield portion extending upwardly from the bowl. The sides of the bowl, other than in the region of the rearward discharge spout, may be shaped so as to hinder or prevent spillage or slopping of waste from the bowl over the seat of the potty, by making them deep and steep.

The potty may be formed in one piece, and is suitably moulded of plastics material. There may be smooth transitions in the surface contours from bowl to seat and to backrest. A smooth, glossy surface, and absence of crevices, will assist cleanliness and hygiene.

BRIEF DESCRIPTION OF THE DRAWINGS

Three embodiments of the invention are illustrated by way of example in the accompanying drawings, in which.

DETAILED DESCRIPTION OF THE INVENTION

Figure 1:
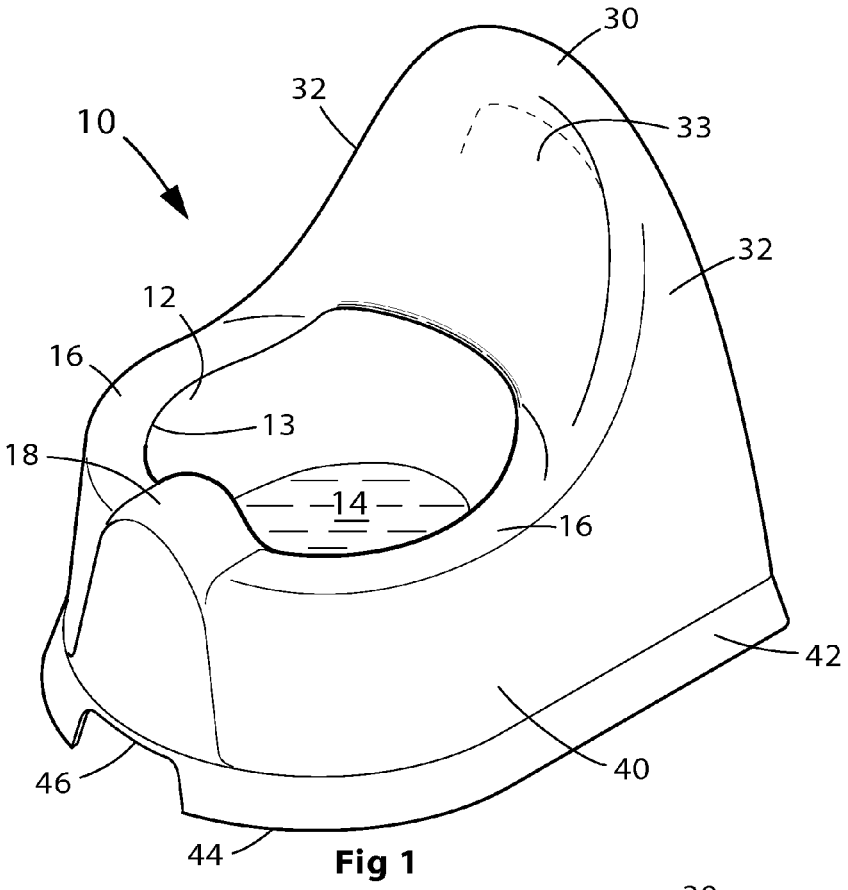
FIG. 1 is an isometric view of a potty in accordance with a first embodiment of the invention from a point above, in front and to one side of the potty.
Figure 2:
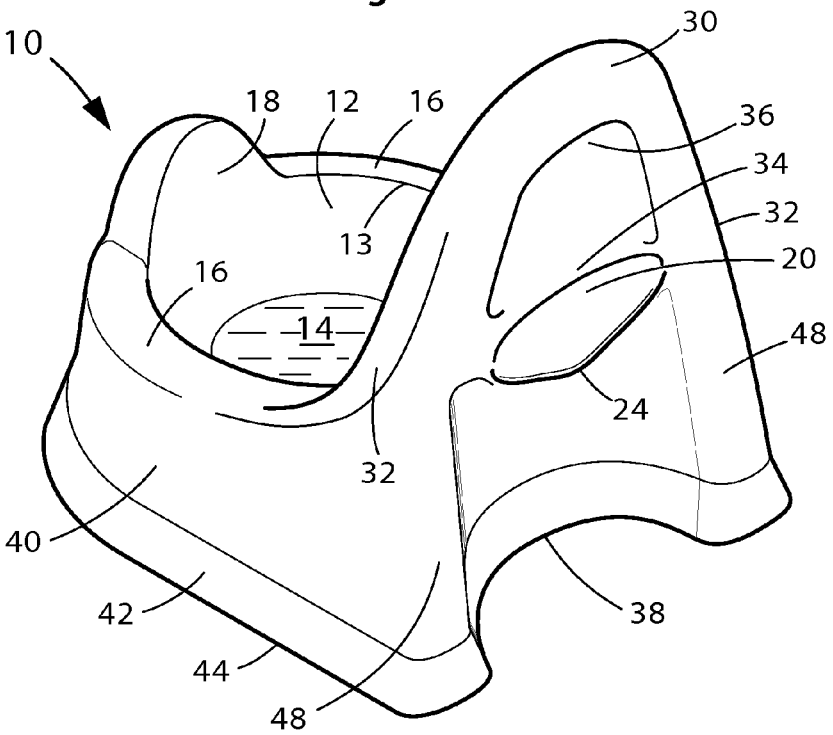
FIG. 2 is a similar view of the same potty from a more rearward viewpoint.

In FIGS. 1 to 6 of the drawings, a child's potty generally designated 10 is formed in one piece as a moulded plastics product. Alternatively, portions of the backrest could be manufactured separately from the bowl, seat and discharge spout, and assembled subsequently.

The structure of the potty includes a seat 16, a waste bowl 12 located below the seat, a waste discharge spout 20 extending upwardly and rearwardly from the waste bowl to a spout outlet 22, and a backrest 30 located between the seat and the spout outlet and extending to a height above the seat.

As hereinbefore noted, the location of the backrest defines the front and back of the potty for the purposes of this specification, and the directions denoted by terms such as, but not limited to, "forwards" and "rearwardly", and terms indicating vertical distance or upward or downward orientation, such as, but not limited to, "below", "height", "base", "lower", and "downwardly", refer to the potty in its normal in-use orientation as illustrated in FIGS. 1 to 5, and in the corresponding Figures of the second and third embodiments.

The bowl 12 contains liquid waste 14. The bowl has an upper rim 13 and is provided with steep sides, near vertical towards the rim, except towards the back of the bowl where rearwardly directed discharge spout 20 forms a conduit or chute which rises from the bowl to its outlet 22 at the back of the potty behind backrest 30.

The seat 16 is formed in two spaced apart portions. Regions of the upper rim 13 of bowl 12 are flattened on either side of the potty to form two opposite seat portions 16, but at the rear of the bowl the upper rim merges smoothly into the front of the backrest 30, while at the front of the bowl a portion of the rim is raised to form a shield 18 to assist in prevent urine from being projected forwards out of the bowl by a child sitting on the seat.

A continuous skirt 40 surrounds the bowl 12. This skirt extends downwardly from the seat portions 16 of the rim of the bowl on either side, and below the shield portion 18 at the front, and below the backrest 30 at the rear of the potty. A lower portion of the skirt 40 around the potty is splayed out to form a foot 42. The lowermost edge 44 of the skirt, which is the termination of the foot 42, follows a substantially planar configuration and forms a stable base on which the potty can be set down on a flat surface. The edge of 44 is lower than the lowest part of the bowl, so that the bowl is supported, dependent from its upper rim, within the skirt 40, clear of any flat surface on which the potty may be placed.

Figure 3:
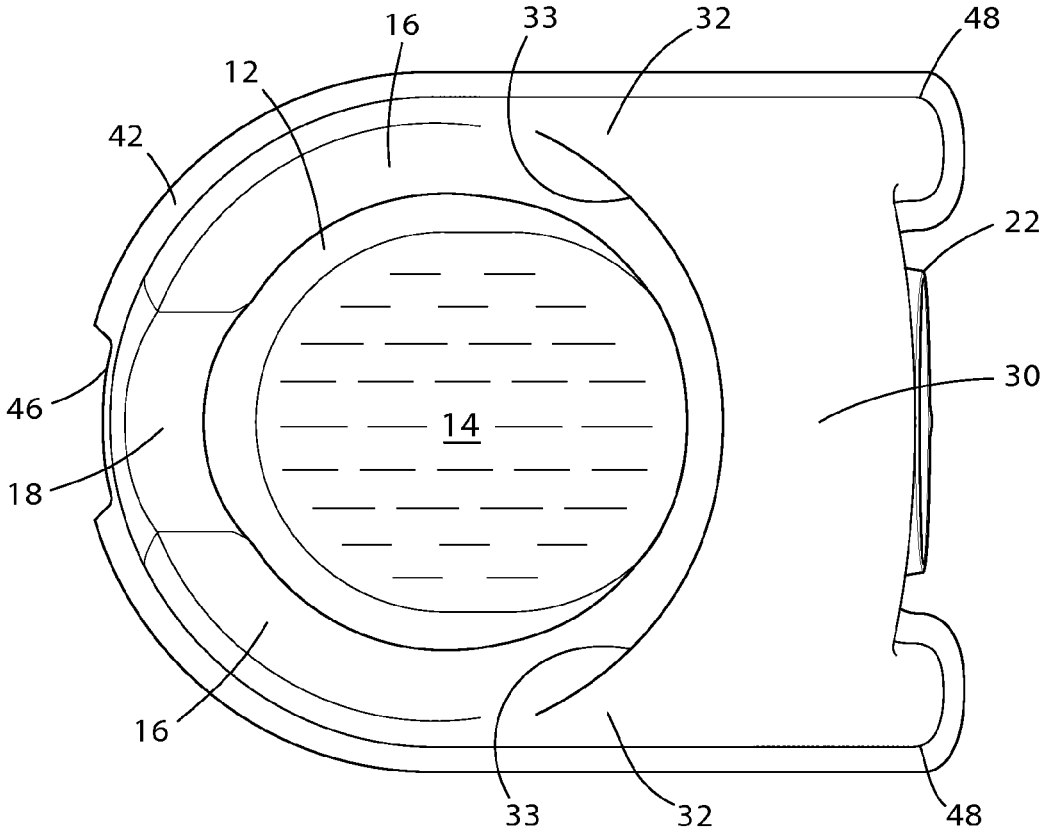
FIG. 3 is a plan view of the potty.
Figure 4:
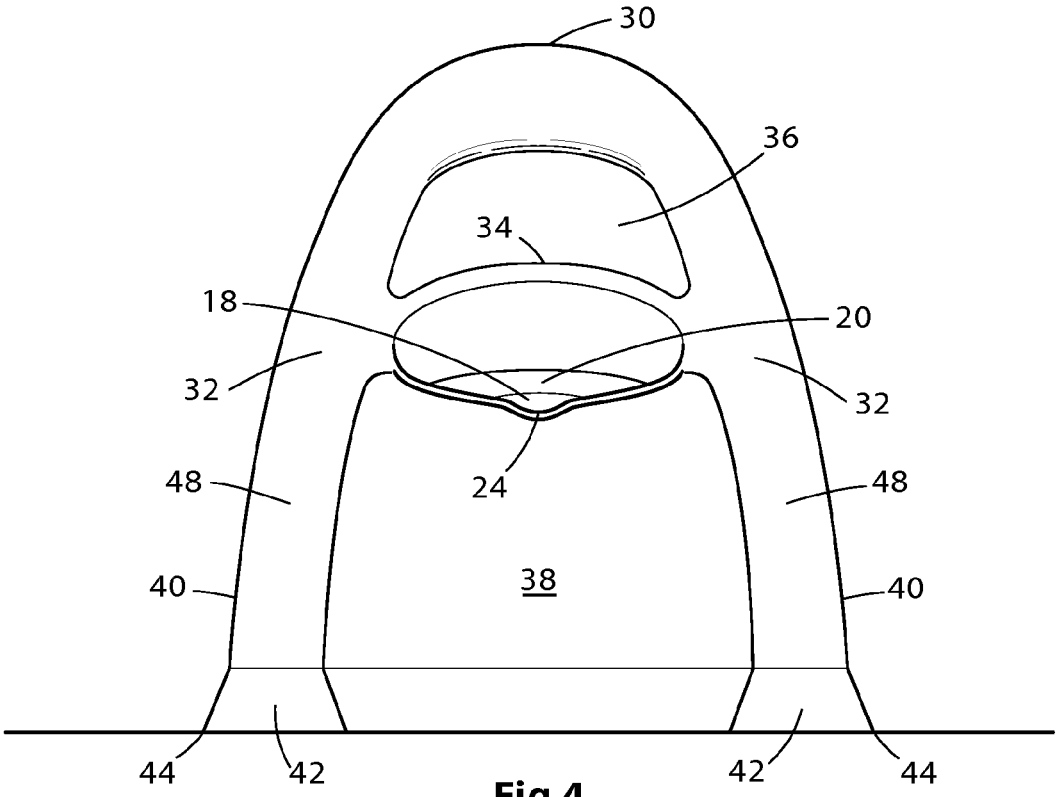
FIG. 4 is a rear view.

The backrest 30 has side portions 32 which extend forwardly towards the seat portions 16 on either side of the bowl, so that the backrest has a concave front surface 33 when viewed in plan (FIGS. 1,3). As clearly shown in FIGS. 2 to 6 in particular, discharge spout 20, which extends from bowl 12 to outlet 22, passes between the two opposite side portions of the backrest.

Figure 5:
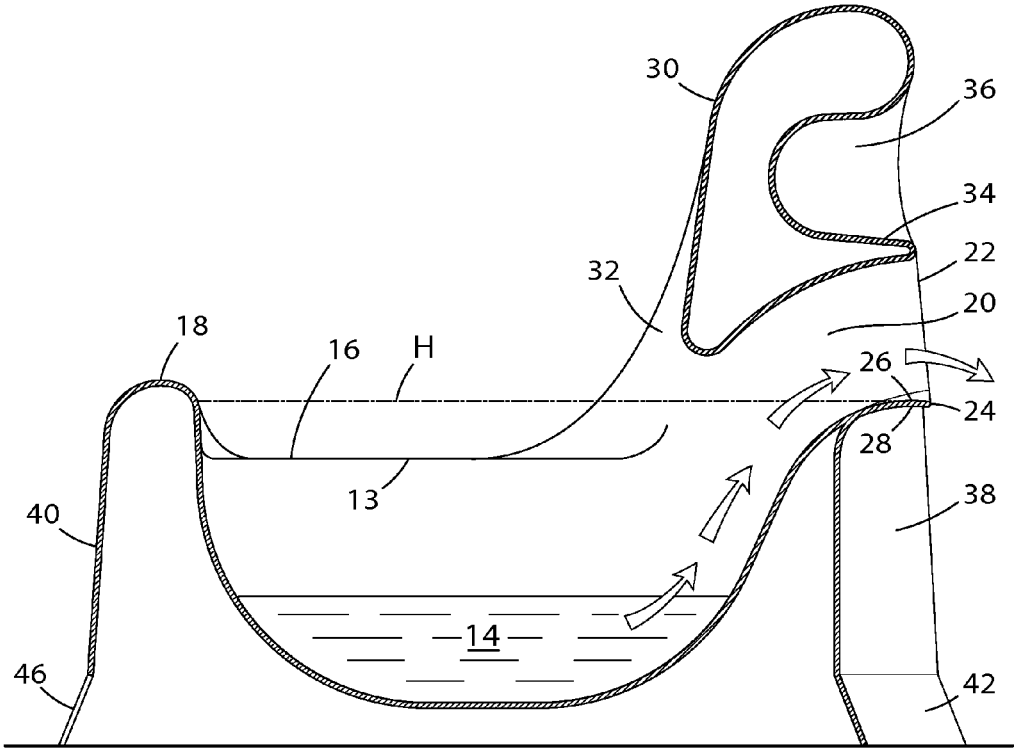
FIG. 5 is a side view, in longitudinal cross section.
Figure 6:
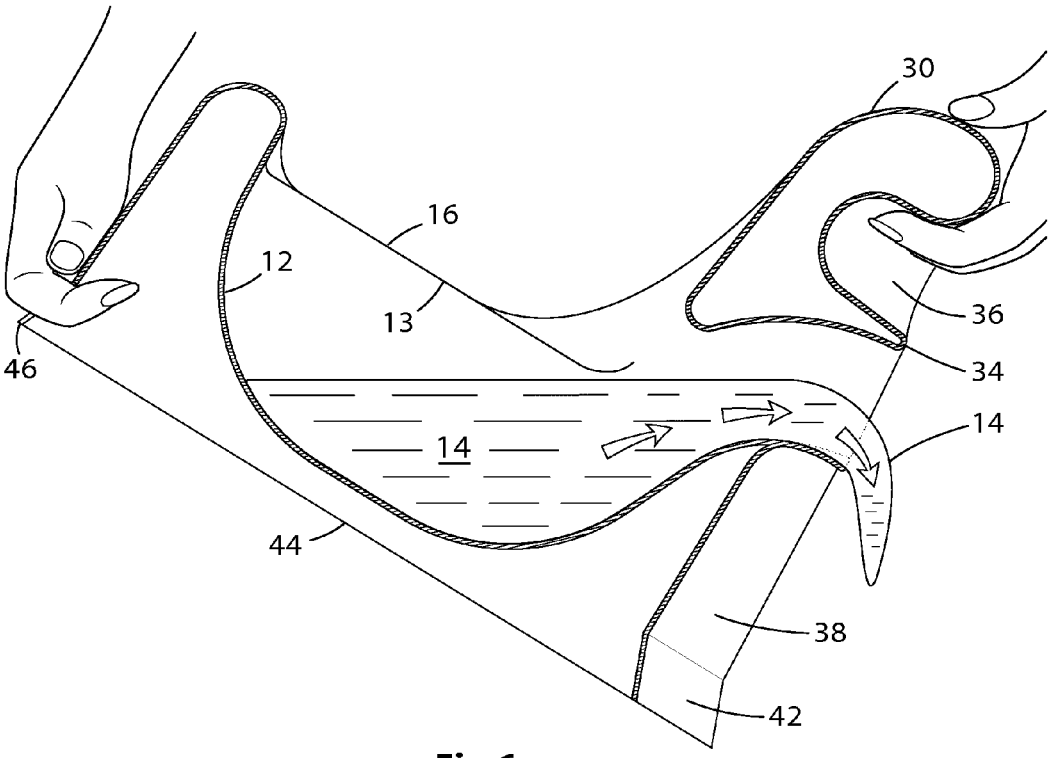
FIG. 6 shows the same cross section as FIG. 5, but the potty being lifted and tilted backwards to discharge waste.

The backrest extends to a substantial height above the seat, and discharge spout 20 rises from the bowl 12 below the backrest and passes upwardly and rearwardly under and through the backrest, between the side portions, to outlet 22 at a height H above the level of the seat portions 16, which in this instance are the lowest parts of the upper rim 13 of the bowl 12. The outlet is angled slightly upwardly, while the lower part of the spout conduit, that is to say its floor, terminates in a downwardly inclined lower pouring lip 24, which has an upper surface 26 and an underneath surface 28 leading towards it, adjacent the discharge outlet, and these surfaces are suitably substantially horizontal or, as illustrated in FIG. 5, slightly downwardly inclined to reduce the risk of liquid poured from the spout running around the pouring lip and back down the outside of the potty at the rear.

The rearward-facing surface of the backrest 30 is formed with a hand grip provided by an upper recess 36 forming a finger hold (FIGS. 5,6), and a protective dividing member 34 separates this upper recess from the discharge spout 20 below it. This dividing member provides some protection for the hand, shielding it against splashes from the spout when the potty is emptied, by extending across and enclosing the top of the discharge conduit, and forming a cover for it.

A second hand grip at the front of the potty is provided by a recess 46 in the foot 42 of the skirt 40, forming a finger hold below the shield portion 18.

The rear of the potty is also formed with a lower recess 38 below the outlet 22, between rearward extensions 48 of skirt 40. The open outlet 22 of spout 20 accordingly lies above recess 38, between the rearward side extensions 48 and the side portions 32 of the backrest and the rearward skirt extensions 48 effectively shield the outlet 22 from a child sitting on the potty.

For emptying, the potty is carried to a suitable waste disposal point, such as a flushable WC, and tilted backwards (FIG. 6) while being held by an adult with two hands in the respective hand grips 36,46. During this process, the seat of the potty in particular, and the sides too, are kept free of contamination by the liquid waste 14, contributing greatly to improved hygiene in subsequent use of the potty. The configuration of the spout outlet ensures that waste can be poured into a disposal receptacle with a reduced risk of spillage or contamination of the seat rim and outside surfaces of the potty, in contrast to conventional potties which are prone to contamination of those areas in contact with the user as effluent fluid clings to the potty sides and seat and does not easily discharge in a fully controlled manner.

In the second embodiment of the invention shown in FIGS. 7 to 12 of the drawings, a child's potty generally designated 110 is also formed in one piece as a moulded plastics product, although again a separable backrest portion is potentially envisaged. Except as distinctly pointed out in this description or as shown in the drawings, potties 10 and 110 of the first two embodiments of the invention correspond, and the description of the first embodiment applies equally to the second. Parts which are substantially unchanged between the two embodiments are given the same reference numerals in each.

Figure 7:
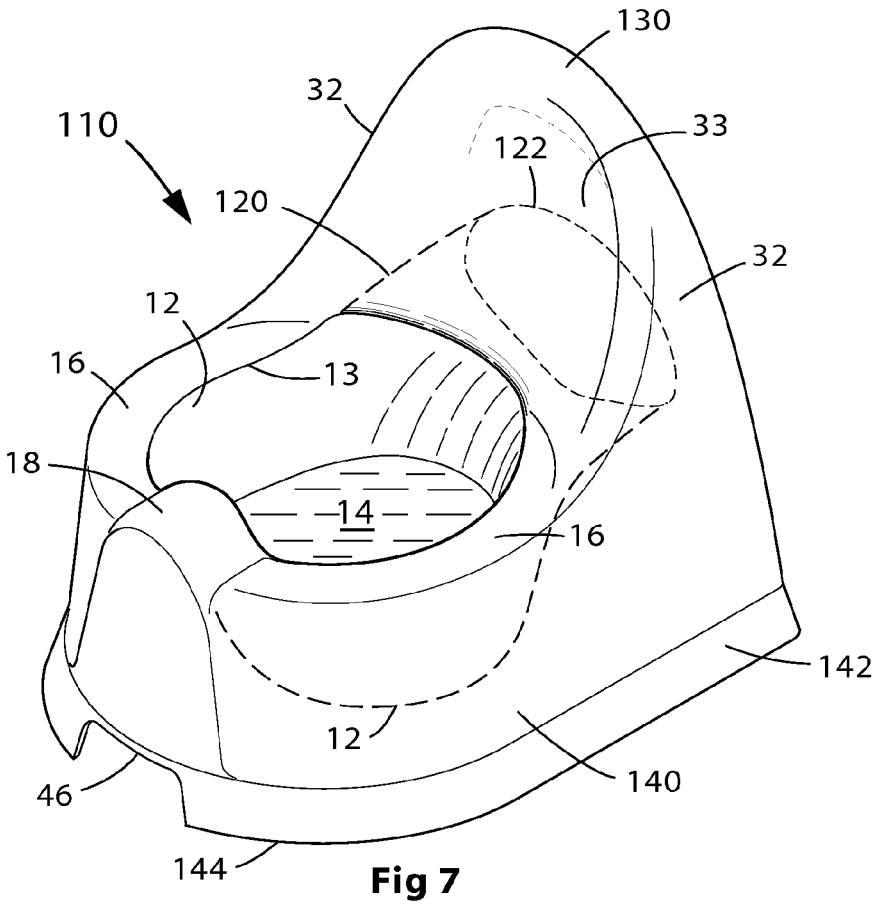
FIGS. 7 to 12 are corresponding views of a potty in accordance with a second embodiment of the invention.
Figure 8:
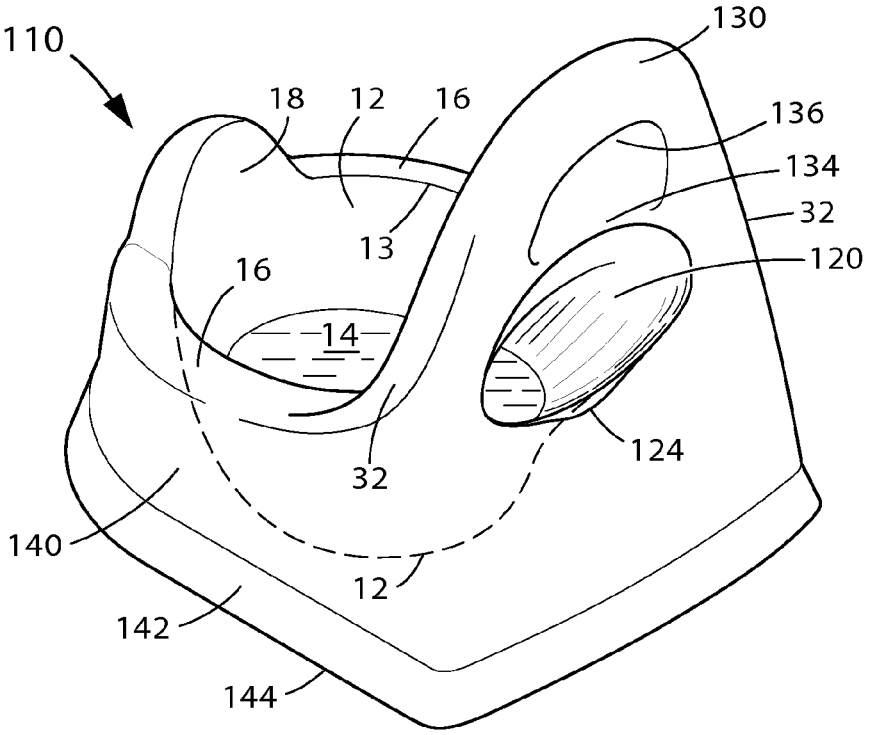

When seen from the front, as in FIG. 7, the potty 110 is substantially identical to the potty 10 as seen in FIG. 1. It comprises a bowl 12 for containing liquid waste 14. Towards the back of the bowl rearwardly directed discharge spout 120 rises from the bowl to its outlet 122 at the back of the potty behind backrest 130.

The upper rim 13 of bowl 12 merges at the rear of the bowl smoothly into the front of the backrest 130. Dashed lines in FIG. 7 indicate the extent of the bowl 12, rearwardly directed discharge spout 120 and discharge outlet 122 where they are not visible in this view inside and behind the potty.

A continuous skirt 140 surrounds the bowl 12. At the front and sides of potty 110, this skirt is the same as skirt 40 in FIGS. 1 through 6, but it has a different shape at the rear of the potty. It still provides a stable base for the potty by means of its lowermost edge 144, which is the termination of the outwardly splayed foot portion 142 of the skirt 140.

Figure 9:
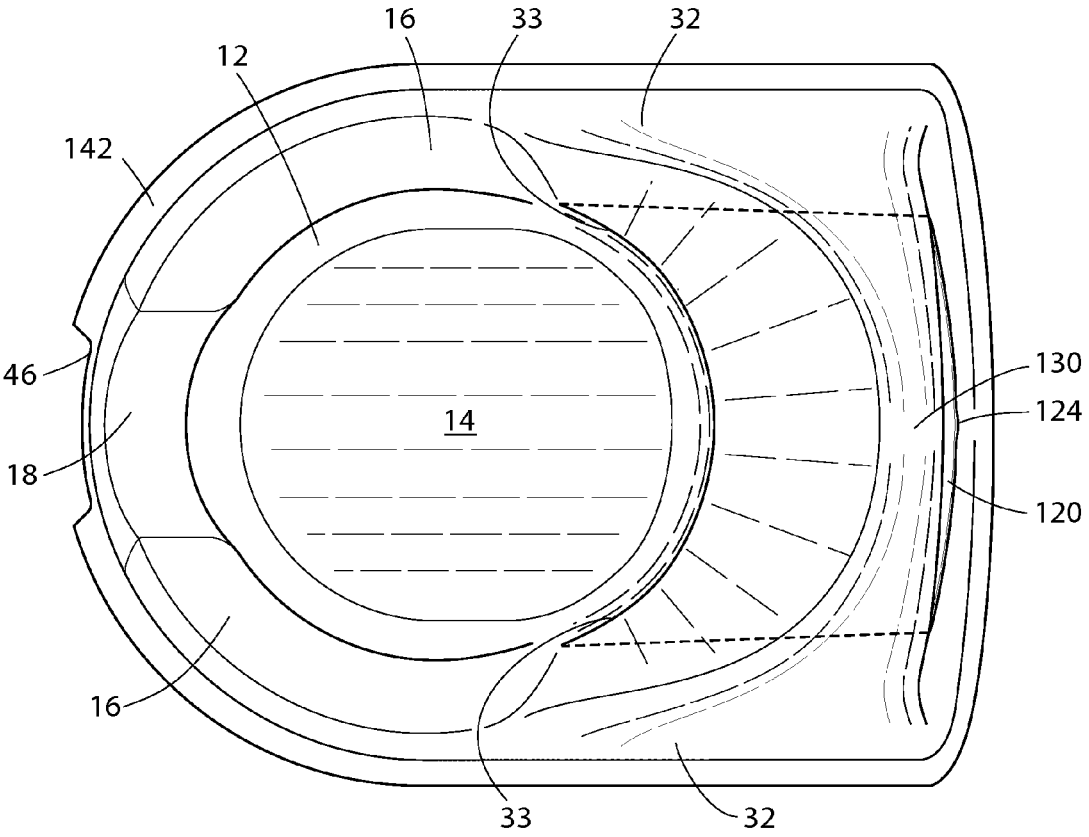
Figure 10:
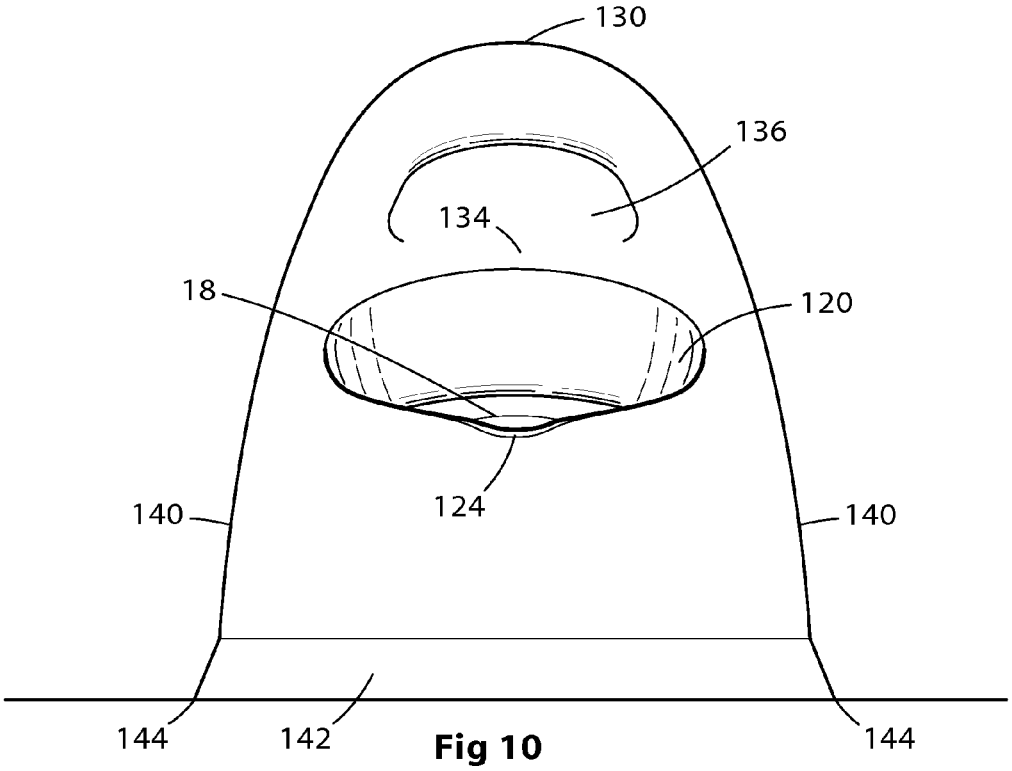

The backrest 130 again has side portions 32 which extend forwardly towards the seat portions 16 on either side of the bowl, so that the backrest has a concave front surface 33 when viewed in plan (FIGS. 7,9). As clearly shown in FIGS. 7 to 12, discharge spout 120, which extends from bowl 12 to outlet 122, passes between the two opposite side portions 32 of the backrest.

Discharge spout 120 rises from the bowl 12 below the backrest 130 and passes as a tubular conduit under and through the backrest, passing between the side portions, to discharge outlet 122 at a height H above the level of the seat portions 16. In this embodiment too, the seat portions 16 are formed on the lowest regions of the bowl's upper rim 13. The spout is directed generally upwardly throughout its length from bowl to outlet. It terminates in a slightly downwardly inclined lower pouring lip 124.

Figure 11:
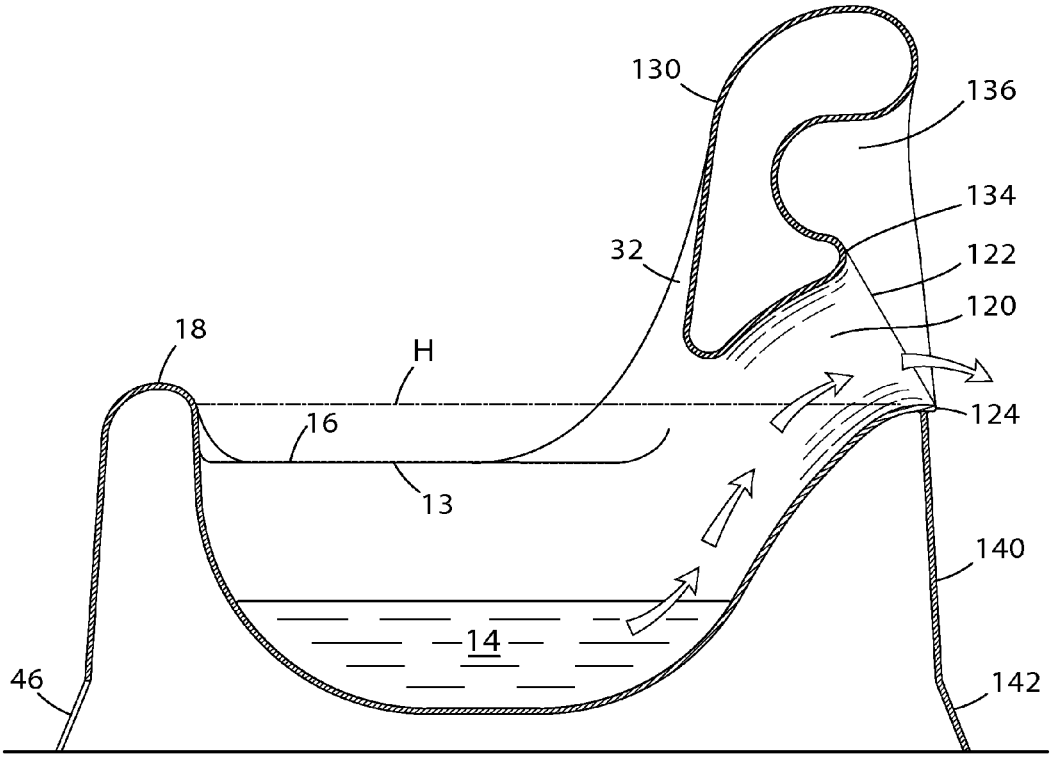
Figure 12:
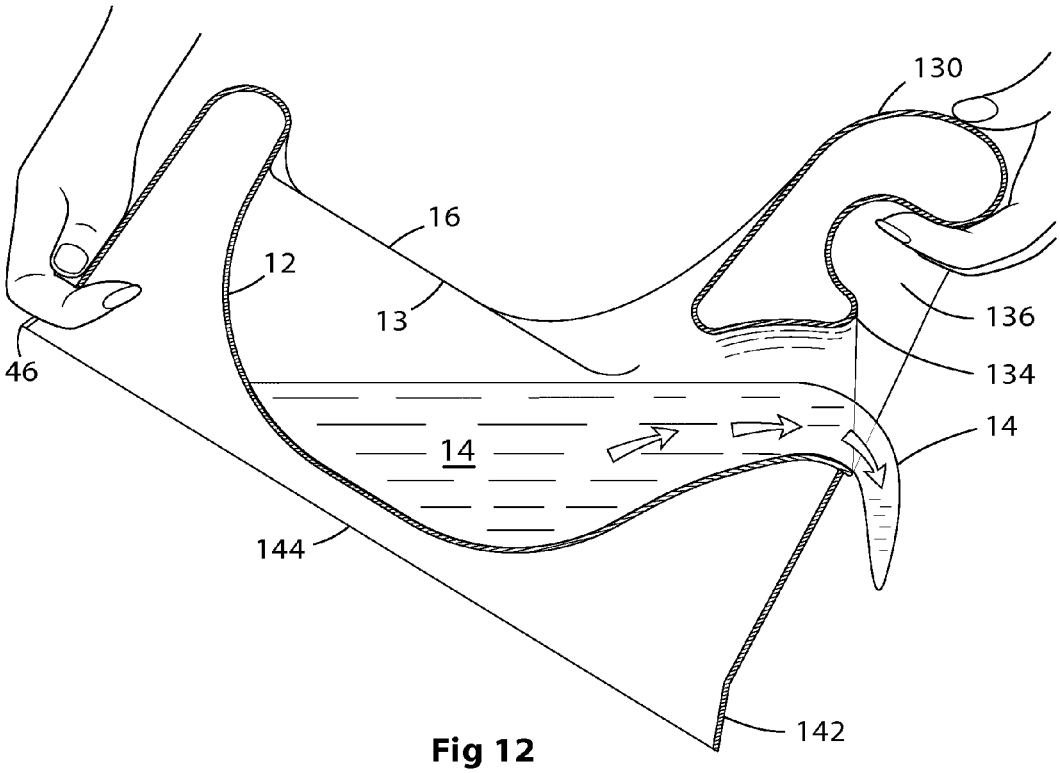

The rearward-facing surface of the backrest 130 is formed with a hand grip provided by an upper recess 136 forming a finger hold (FIGS. 11,12), and a short dividing member 134 separates this upper recess from the discharge spout 120 below it, and forms an upper enclosing wall or cover to the discharge spout in this part of the potty. By shortening this dividing member 134 as compared with dividing member 34 (FIGS. 5,6), the open top of the discharge spout outlet 122 is brought somewhat back into the backrest, and the whole outlet 122, as indicated in FIG. 11, becomes more upwardly directed and less dimensionally restricted, allowing easier manual access to the interior of the discharge spout for cleaning and sterilizing purposes. The discharge spout has a rounded oval section, between about 100 mm and 140 mm in width, and between about 80 mm and 95 mm in height (measured perpendicularly to both the width and the central axis of the conduit) at its narrowest part, where it is covered and enclosed overhead by dividing member 134. These dimensions afford an adult good access for cleaning, as well as good concealment from a child sitting on the potty, and good control on emptying it.

The skirt 140 at the rear of the potty below the discharge outlet 122 is in this embodiment formed without any lower recess, so that the open outlet 122 of spout 120 lies above a generally flat area of the skirt 140, though still with the splayed foot portion 142. It is thus easy to wash, wipe clean, and dry.

The potty 110 is emptied in the same manner as potty 10 of the first embodiment.

In the third embodiment of the invention shown in FIGS. 13 to 17 of the drawings, a child's potty generally designated 210 is again formed as a moulded plastics product. Except as distinctly pointed out in this description or as shown in the drawings, potties 110 and 210 of the second and third embodiments of the invention correspond, and the description of the second embodiment applies equally to the third. Parts which are substantially unchanged between embodiments are given the same reference numerals in each.

The principal differences in the third embodiment lie firstly in a greatly enlarged discharge spout opening, secondly in that this enlarged opening permits the backrest to be formed as a slender bridge over the spout from one side to the other, thirdly that this enables the top of the bridge itself to act as the rear hand grip, obviating the need to mould a separate finger hold into a rear surface of the potty, and fourthly that the top of the bridge may then be moulded as a separate piece, so that while the two opposite sides of the backrest are still integral with the rest of the potty, rising up on either side of the discharge spout below the backrest, and perform at least part of the back rest function as in the first and second embodiments, the hand grip which is formed as the bridge portion of the back rest joining the two side portions is enabled to be optional, being separable from and replaceable on the side portions. This gives a number of advantages. It enables the production process to be carried out with potentially simple and economical mould forms; the potty and its separable hand grip can be made in contrasting colours, even in different materials, potentially benefiting both design aesthetics and design flexibility; the hand grip can be completely removed for thorough cleaning inside the discharge spout area; and when the hand grips are removed from their back rests, a plurality of such potties can be closely nested and stacked.

Apart from the specific shape of the backrest 230, its being formed in three parts, and the specific conformation of the walls of discharge spout 220, the potty 210 as shown in FIGS. 13, 14, 15 and 17 appears substantially identical to the potty 110 as seen in FIGS. 7-12. It comprises two seat portions 16 formed on the lowest regions of rim 13 on opposite sides of a bowl 12 for containing liquid waste 14. Towards the back of the bowl the rearwardly directed discharge spout 220 rises upwardly from the bowl below backrest 230 and passes between backrest side portions 232 to its outlet 222 at the back of the potty behind the backrest. Dashed lines in FIGS. 13 and 14 indicate the extent of the space occupied by bowl 12 within the potty. As in the second embodiment, continuous skirt 140 surrounds the bowl 12. The foot portion 142 and the stable base provided by lowermost edge 144 are unchanged.

Figure 13:
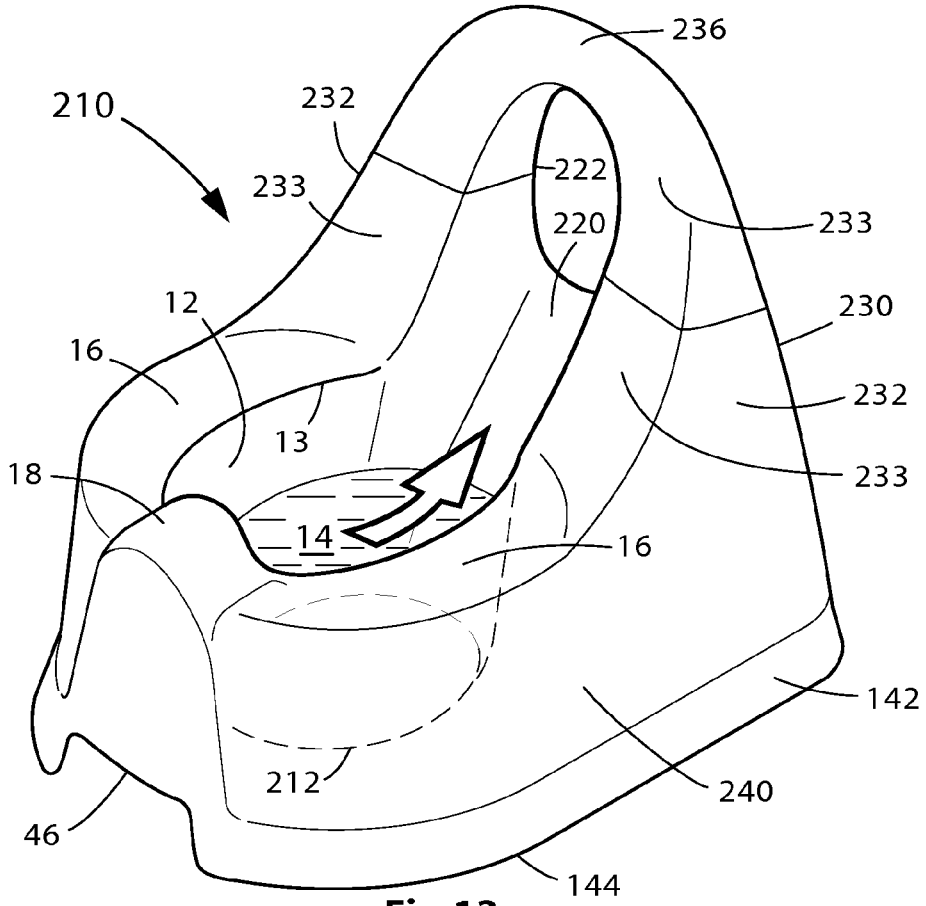
FIGS. 13 to 18 are corresponding views of a potty in accordance with a third embodiment of the invention.
Figure 14:
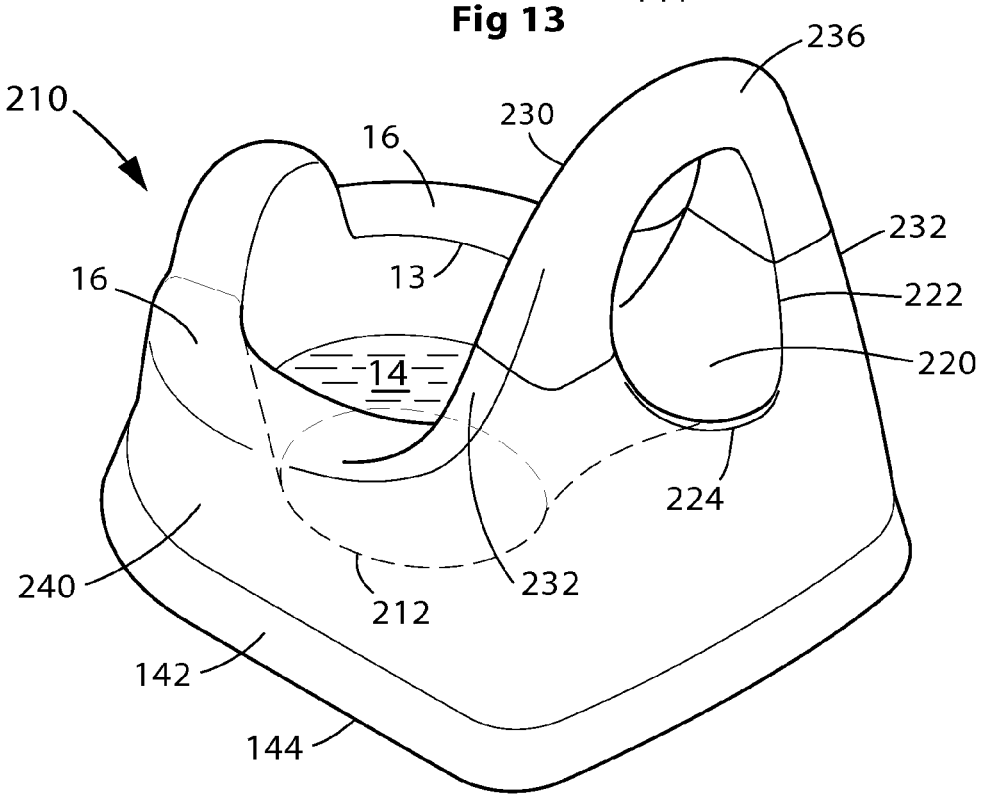
Figure 15:
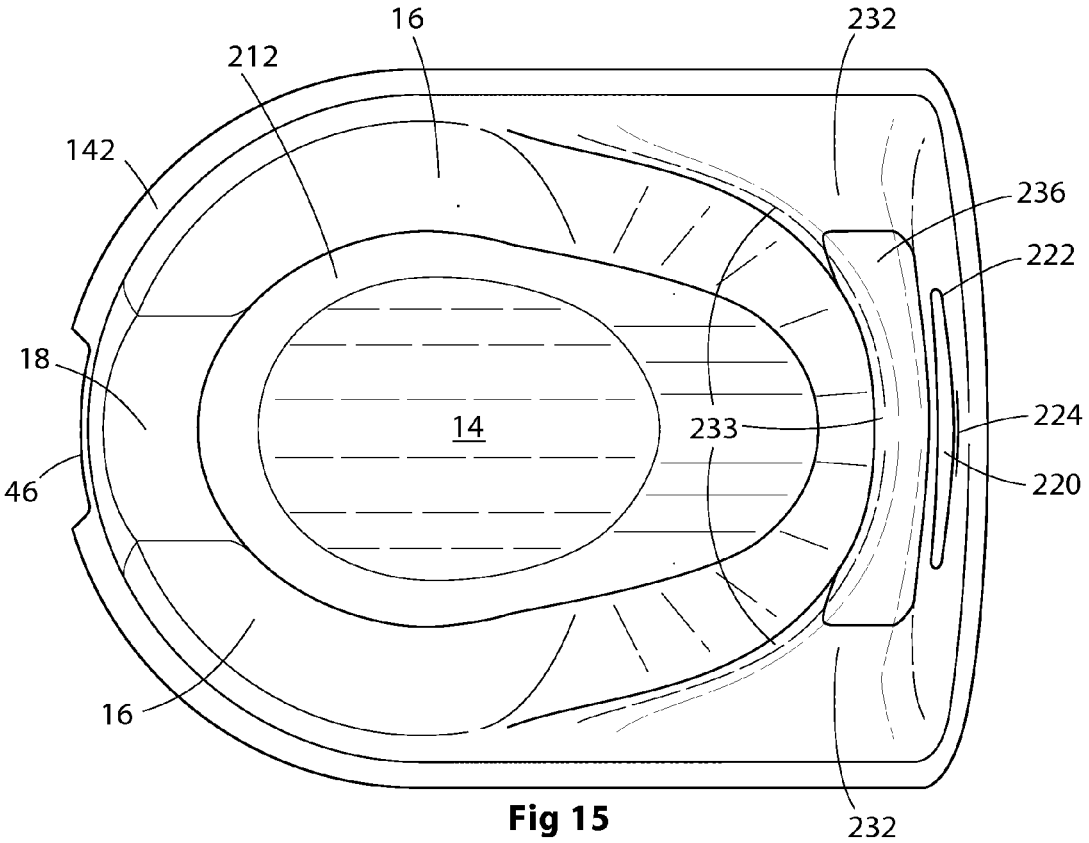

The two opposite backrest side portions 232 extend forwardly on either side of the discharge spout towards the seat portions 16 on either side of the bowl, so that the backrest has concave forward-facing surfaces 233 when viewed in plan (FIGS. 13,15). Side portions 232 rise above discharge spout 220 on opposite sides of it, and a centre backrest bridge portion 236 connects the two side portions, providing a hand grip or carrying handle. By comparing FIG. 17 with FIG. 11 and FIG. 5, it will be apparent that the protective dividing member 34 of the first embodiment, which was reduced in extent in the dividing member 134 of the second embodiment, has been eliminated entirely in the third embodiment.

Figure 16:
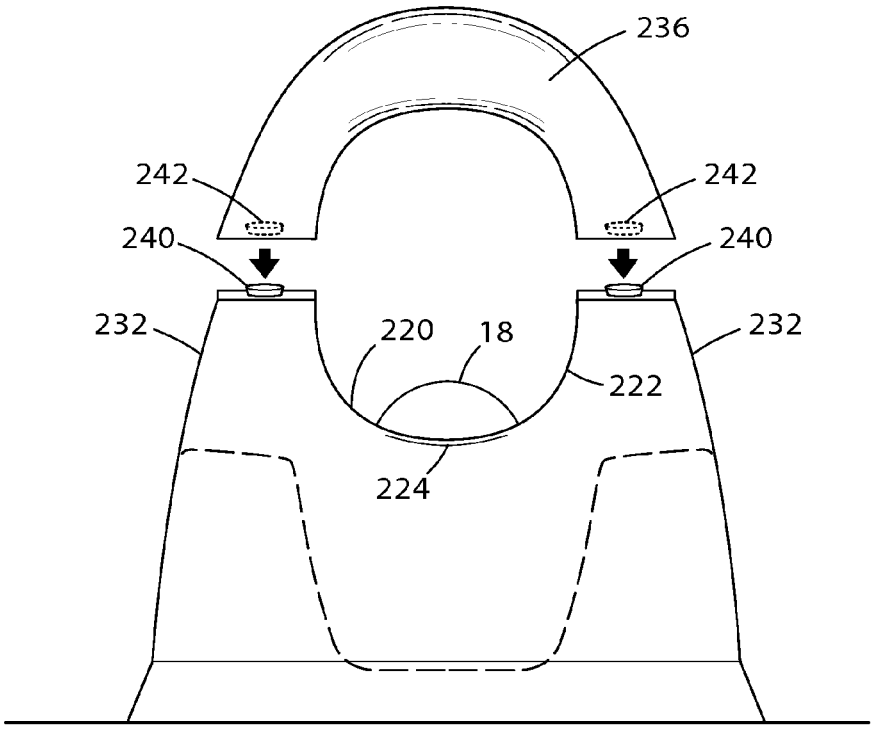
Figure 17:
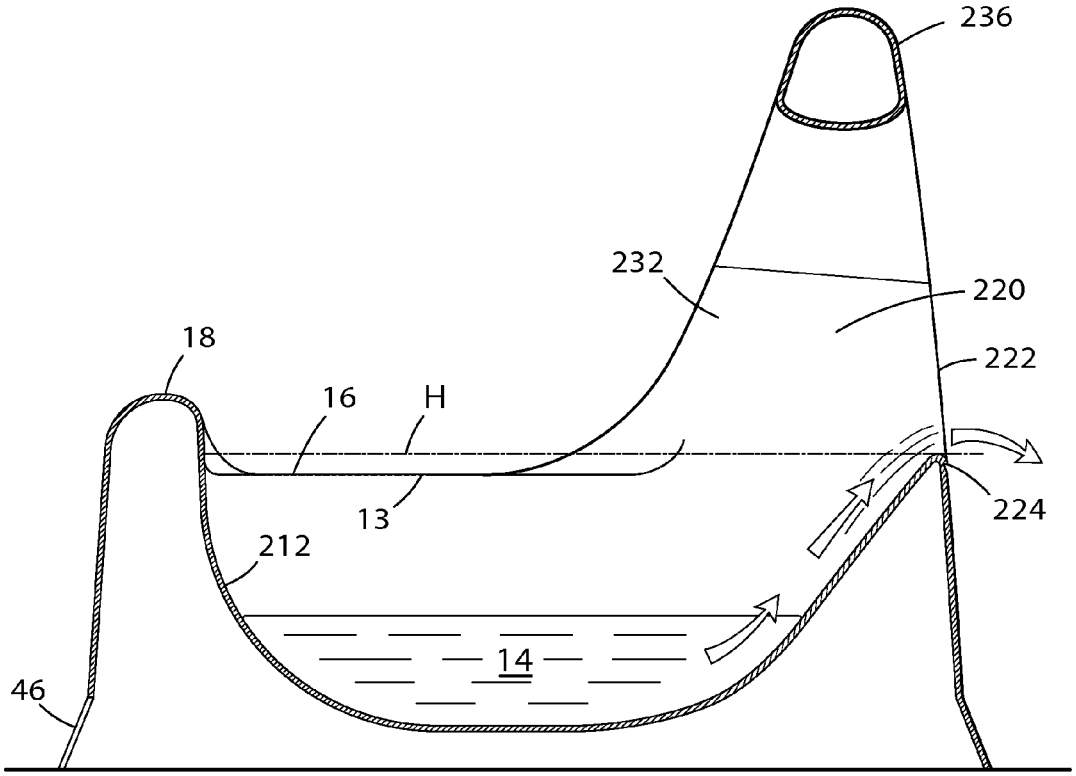

FIG. 16 illustrates the carrying handle 236 separated from the two backrest portions 232. Releasable engagement means are provided to connect the carrying handle to the backrest. Various forms of engagement means may be provided, but in this instance simple snap fit connectors are preferred. The illustrated embodiment comprises a pair of upstanding nibs 240 on the fixed backrests 232, receivable in and engageable with a pair of corresponding sockets 242 on the hand grip 236. The particular forms of the nibs and sockets, any tapers and their relative dimensions, and the deformability of the plastics material of which they are made, are selected so that strength of the snap fit connectors is sufficient to reliably maintain engagement during normal use of the potty, including carrying and emptying, but to permit disengagement when required, for cleaning, for use of the potty without the handle 236, or for stacking a plurality of potties.

Discharge spout 220 rises from the bowl 212 below the backrest 230 and passes between the backrest side portions to discharge spout outlet 222 behind the backrest at a height H above the level of the seat portions 16. The spout is directed generally upwardly throughout its length from bowl to outlet, where a pouring lip 224 is provided. The slender and high arched form of backrest 230, even with the removable bridging portion 236 in place, gives an outlet 222 that allows easy and speedy pouring whereby to empty the potty after use, and affords easy access to the spout for cleaning purposes.

Figure 18:
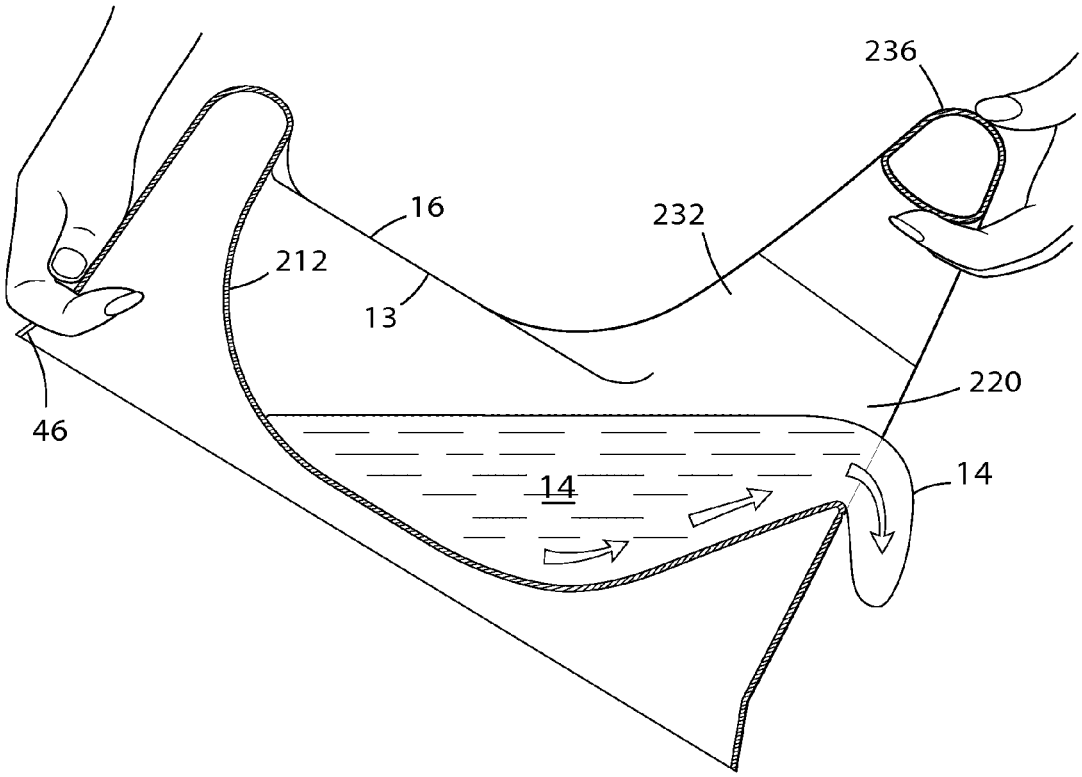

As shown in FIG. 18, the potty 210 is emptied in the same manner as potties 10 and 110 of the first and second embodiments. If the hand grip 236 is absent, the potty can be supported by the user's corresponding hand at a convenient location under the skirt 140.

Features of the three embodiments may be combined or interchanged or modified, to take advantage of their various benefits, in any convenient way. Thus, for example, it is possible to combine the larger opening dimensions of discharge spout of the second embodiment, for easier cleaning, with the longer dividing member 34 of the first embodiment, for enhanced splash protection on emptying. The backrests may be modified, such as by altering the heights of the backrests 30/130/230, and by changing the positions, and the forms, of any rear hand grips incorporated in the backrests, whether as recesses like 36/136 or as handles like the bridging arch 236. Other backrest modifications may be widely made: the principal purpose of the backrest is to firmly locate the child on the potty forward of the discharge spout, so that the seat and the discharge spout are clearly separated, but secondary benefits may arise to a greater or lesser extent according to the particular design employed. Thus, a high backrest may make it more difficult for the child to turn on the seat and reach into the discharge spout, and may also allow the inclusion of either an integral, or a separable, hand hold above the spout for emptying the potty safely. Other changes and modifications within the scope of the invention will be apparent to those skilled in the art.

The invention claimed is:

1. A portable child's potty comprising a waste bowl, a seat comprising two opposite seat portions situated on either side of the bowl, an upwardly and rearwardly directed waste discharge spout extending from the bowl to a rearward spout outlet, and a backrest comprising side portions extending to a height above the seat, wherein the waste bowl is located below the seat, the backrest is located between the seat and the discharge spout outlet, and the discharge spout passes between said two opposite side portions of the backrest to the outlet at the rear of the potty.

2. A potty according to claim 1 wherein the side portions of the backrest extend forwardly towards the seat portions on either side of the bowl.

3. A potty according to claim 2 wherein the bowl is provided with an upper rim and said seat portions are formed on said rim forward of the backrest.

4. A potty according to claim 3 wherein the potty is of moulded plastics, and said bowl, seat, discharge spout and side potions of the backrest are formed in one integral piece.

5. A potty according to claim 1 wherein the backrest includes a backrest hand grip above the discharge spout.

6. A potty according to claim 5 wherein the said backrest hand grip comprises a backrest bridge portion connecting the side portions of the backrest above the discharge spout.

7. A potty according to claim 1 wherein the bowl is provided with an upper rim and the spout outlet is higher than the lowermost part of said rim.

8. A potty according to claim 7 wherein the seat is formed on said rim and the spout outlet is higher than the seat.

9. A potty according to claim 1 wherein the upwardly extending discharge spout terminates in a pouring lip at the spout outlet.

10. A potty according to claim 1 wherein a front hand grip is provided at the front of the potty.

11. A potty according to claim 10 where the said front hand grip is formed in the outside of a front skirt to the bowl and comprises a recess forming a finger hold.

12. A moulded plastics child's potty comprising:

a child seat formed on a rim of a waste bowl, said waste bowl being located below the seat;

a dependent skirt extending downwardly from the rim of the waste bowl outside and around the bowl and terminating in a lower edge which forms a base adapted to support the potty when the potty is placed on a level surface;

a child backrest adjacent the seat and extending to a height above the seat, the location of the backrest in relation to the seat defining a rearward direction of the potty, and the backrest having a surface facing forwardly over the seat whereby to obstruct movement of a child towards the rear of the potty when sitting on the seat; and a waste discharge spout extending upwardly from the bowl to a spout outlet rearward of the bowl and rearward of the backrest;

wherein the backrest includes two opposite side portions situated on either side of the waste discharge spout.

13. A moulded plastics child's potty according to claim 12, including a hand grip located in the said skirt around the waste bowl, for use in lifting the potty and tilting it rearwardly to empty liquid waste from the waste bowl along the discharge spout to the discharge spout outlet behind the backrest.

14. A moulded plastics child's potty according to claim 12, wherein the backrest includes a backrest hand grip above the discharge spout.

15. A moulded plastics child's potty according to claim 14, wherein the said backrest hand grip comprises a backrest bridge portion connecting the side portions of the backrest above the discharge spout.

16. A moulded plastics child's potty according to claim 12 wherein the spout outlet is higher than the seat.

17. A moulded plastics child's potty according to claim 16 wherein the upwardly extending discharge spout terminates in a pouring lip at the spout outlet.

* * * * *